United States Patent [19]

Hattori

[11] Patent Number: 5,006,051

[45] Date of Patent: Apr. 9, 1991

[54] ROTARY TWO-CYLINDER COMPRESSOR WITH DELAYED COMPRESSION PHASES AND OIL-GUIDING BEARING GROOVES

[75] Inventor: Hitoshi Hattori, Kanagawa, Japan

[73] Assignee: Kabushiki Kaisha Toshiba, Kanagawa, Japan

[21] Appl. No.: 278,514

[22] Filed: Dec. 1, 1988

[30] Foreign Application Priority Data

Dec. 3, 1987 [JP] Japan ..... 62-304640
Jul. 18, 1988 [JP] Japan ..... 63-177210

[51] Int. Cl.[5] ..... F04C 23/00; F04C 29/02
[52] U.S. Cl. ..... 418/60; 418/94
[58] Field of Search ..... 418/60, 88, 94, 212

[56] References Cited

FOREIGN PATENT DOCUMENTS 58-85389 5/1983 Japan ..... 418/60
61-210285 3/1985 Japan .
62-153590 12/1985 Japan .
61-187587 8/1986 Japan ..... 418/94
61-205390 9/1986 Japan ..... 418/60

*Primary Examiner*—John J. Vrablik
*Attorney, Agent, or Firm*—Finnegan, Henderson, Farabow, Garrett, and Dunner

[57] ABSTRACT

A two-cylinder type rotary compressor with a more durable bearing portion and a higher operational efficiency is provided. In addition, the two-cylinder type rotary compressor significantly reduces vibration and noise generated therefrom.

11 Claims, 12 Drawing Sheets x-z PLANE (a)

y-z PLANE (b)

ROTARY TWO-CYLINDER COMPRESSOR WITH DELAYED COMPRESSION PHASES AND OIL-GUIDING BEARING GROOVES

BACKGROUND OF THE INVENTION

1. Field of the Invention

This invention relates to a rotary compressor, and more particularly to a rotary compressor having two rotary compression mechanisms driven in common by a single rotating shaft supported by journal bearings.

2. Description of the Prior Art

As is well known, a refrigerator or an air conditioner requires a gas compressor. As a compressor for such a use, a rotary compressor is generally used because it can be readily made compact. A rotary compressor is usually constructed such that an electric motor and a compression mechanism driven by this motor are united within a single housing. The compression mechanism has a cylinder and a ring-shaped piston disposed eccentrically within the cylinder. A blade is attached to the cylinder so as to always make slidable contact with the outer circumference of the piston. The blade partitions the inside of the cylinder into a suction chamber and a compression chamber. The suction chamber has a gas-suction inlet, and the compression chamber has a gas-discharging outlet. The housing also serves as a tank to store gas compressed by the rotary compression mechanism.

A two-cylinder type rotary compressor has two rotary compression mechanisms which are driven by a single rotating shaft in common. The two-cylinder type rotary compressor has two rotary compression mechanisms disposed coaxially with respective blades that coincide in phase. The respective pistons of the two rotary compression mechanisms are securely fixed to the outer circumference of the rotating shaft with a phase difference of 180 degrees. Therefore, the two-cylinder type rotary compressor discharges compressed gas twice during one rotation of the rotating shaft. Thus, the two-cylinder type compressor has advantages in that torque fluctuations of the rotating shaft are smaller than in a one-cylinder type rotary compressor. As a result, smaller vibrations and lower noise can be achieved.

Recently, in the field of refrigerators and air conditioners, for the purpose of enhancement of operating efficiency and expansion of controllability, techniques of controlling a compressor with a variable speed control have been employed. The two-cylinder type rotary compressor incorporated in such appliances also has been required to achieve higher rotation performance. Improvement of the rotation performance of the two-cylinder type rotary compressor primarily requires a reduction in vibration and an improvement of relaibility of the bearing portions. For reduction in vibration, balancers are usually fixed at appropriate portions of the rotating shaft so as to compensate for dynamic imbalances of rotation.

However, it is difficult to completely eliminate dynamic imbalances of rotation. In addition, lateral load fluctuations act on the rotating shaft. Thus, the whirling of the rotating shaft is relatively large. This is the same even in the two-cylinder type rotary compressor.

A journal bearing which is superior in durability is usually used as a bearing for the rotary compressor. As is known, the journal bearing interposes an oil film between the journal of the rotating shaft and the inner surface of the journal bearing. The rotating shaft is supported against the oil film pressure. Thus, to exhibit a satisfactory bearing function, it is necessary to invariably introduce lubricating oil into the gap between the journal of the rotating shaft and the journal bearing. For this reason, an oil-guiding groove is formed extending axially on the outer circumferential surface of the rotating shaft, or on the inner surface of the journal bearing. As a result, the lubricating oil is introduced into the gap between the journal of the rotating shaft and the journal bearing by way of the oil-guiding groove.

However, when the above-described whirling of the rotating shaft arises, pressure variations occur in the gap between the journal of the rotating shaft and the journal bearing. Thus, it is difficult to invariably introduce the lubricating oil into the gap of the bearing. This causes the operational efficiency of the rotary compressor to decrease. Moreover, insufficient lubrication causes a direct contact between the bearing and the journal of the rotating shaft. Thus, the bearing and the rotating shaft are frequently damaged. In addition, adoption of the variable speed control technique allows high speed rotation of the rotating shaft. As is known centrifugal force caused by the eccentric rotations increases in proportion to the square of the number of revolutions. Thus, the load of the bearing, which is caused by the deflection of the rotation shaft, increases significantly. Therefore, the importance of appropriate lubrication, including a satisfactory oil-guiding groove has increased.

On the other hand, at present, noise from the two-cylinder type rotary compressor does not differ significantly from that of the one-cylinder type rotary compressor. Reduction in such noise is more difficult to achieve than a reduction in vibrations.

The characteristic noise from the two-cylinder type rotary compressor is a so-called beat, which is relatively noticeable. The beat is derived from the fact that a compressed gas is discharged by two pistons twice at intervals of 180 degrees per one revolution of the rotating shaft.

Specifically, in the case of the two-cylinder type rotary compressor, when the rotation frequency of the rotating shaft is defined as $f_s$Hz, the above-described gas discharge operations produce a load fluctuation and a gas discharge pulsation of $2f_s$Hz. Thus, basically, a noise oscillation of $2f_s$Hz is generated.

Moreover, when the power source frequency of the motor is defined as $f_o$Hz, the motor that drives the rotation shaft generates a magnetic oscillation of $2f_o$Hz due to magnetic unbalance.

Further, in the case of the two-cylinder type rotary compressor, unlike the one-cylinder type one, the above-described noise frequency of $2f_s$Hz is relatively large. Thus, the frequency difference between $2f_o$Hz and $2f_s$Hz is extremely small. Therefore, a beat of low frequency of $2(f_o-f_s)$Hz is generated. The beat becomes a noticeably objectionable noise.

SUMMARY OF THE INVENTION

Accordingly, one object of this invention is to provide a two-cylinder type rotary compressor with a more durable bearing portion, and a higher operational efficiency.

Another object of this invention is to significantly reduce vibration and noise in a two-cylinder type rotary compressor.

Briefly, in accordance with one aspect of this invention, there is provided a two-cylinder type rotary compressor which includes two rotary compression mechanisms driven by a rotating shaft in common. The two-cylinder type rotary compressor also includes a pair of journal bearings for supporting the rotating shaft at portions projecting from both the upper and lower sides of the two compression mechanisms.

The pair of journal bearings, each has oil-guiding groove on the inner surface thereof for introducing lubricating oil into the entire portion between the journal of the rotating shaft and the inner surface of the journal bearing.

One of the oil-guiding grooves is formed on the inner surface of the journal bearing near the motor, in a range of 220 to 325 degrees defining the position of the blade as 0 degrees. The other oil-guiding groove is formed on the inner surface of the journal bearing separated from the motor, in a range of 190 to 310 degrees defining the position of the blade as 0 degrees.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
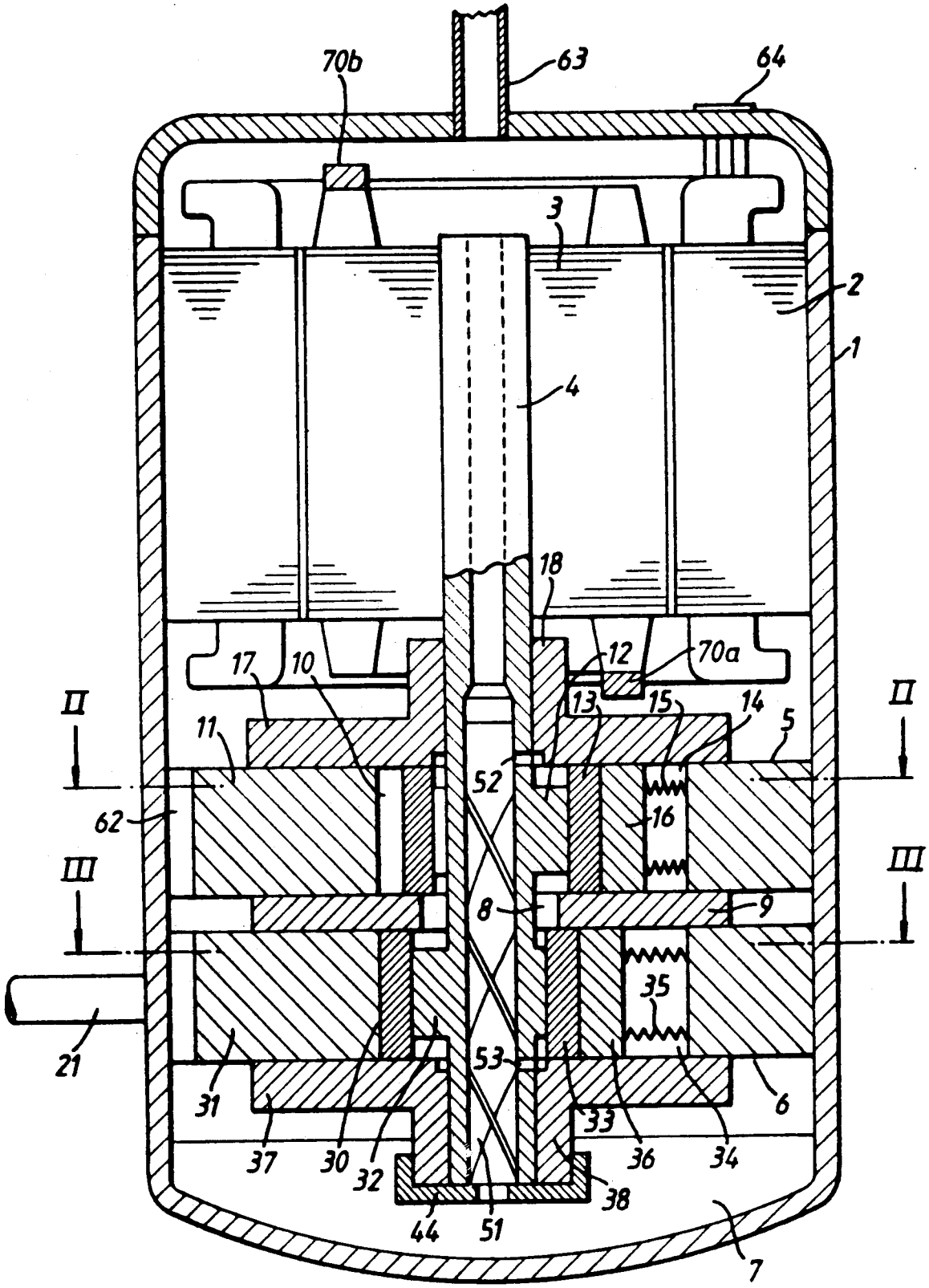
FIG. 1 is a longitudinal sectional view illustrating a rotary compressor according to one embodiment of the present invention.

Referring now to the drawings, wherein like reference numerals designate indentical or corresponding parts throughout the several views, and more particularly to FIG. 1 thereof, a longitudinal sectional view of a rotary compressor according to one embodiment of the present invention is illustrated. In FIG. 1, reference numeral 1 designates a housing in which a cylindrical space is provided. The axial line of the housing 1 is disposed in parallel to the direction of gravity. An electric motor 2, such as an induction motor, is disposed at the upper side of the housing 1. Two rotary compression mechanisms 5 and 6 are disposed coaxially at the lower side of the housing 1. The rotary compression mechanisms 5 and 6 are driven in common by a rotating shaft 4 coupled directly to a rotor 3 of the motor 2. Further, a specified amount of a lubricating oil 7 is stored in the bottom portion of the housing 1.

The rotary compression mechanisms 5 and 6 are disposed adjoining vertically with a partition plate 9 therebetween. The partition plate 9 has a hole 8 at its center portion. The rotating shaft 4 is disposed piercing through the hole 8.

The rotary compression mechanism 5 is constituted as follows. Specifically, a cylinder 11 is disposed in close contact on the partition plate 9. The cylinder 11 has a cylindrical space 10 having a diameter larger than that of the hole 8. The rotating shaft 4 passes through the cylindrical space 10. The outer circumference surface of the cylinder 11 is securely fixed to the inner circumference surface of the housing 1. An eccentric portion 12 is securely fixed to the outer circumference surface of the part of the rotating shaft 4 positioned within the cylindrical space 10. A ring-shaped piston 13 is fitted with the outer circumference surface of the eccentric portion 12. Further, a guide groove 14 which extends radially is disposed on the cylinder 11. The one end of the guide groove 14 is opened to the cylindrical space 10. A blade 16 is fitted within the guide groove 14. The blade is always energized by a spring 15 in the direction of the rotating shaft 4. Moreover, a flange portion 17 is provided on the upper surface of the cylinder 11. The flange portion 17 closes the upper opening of the cylindrical space 10. A journal bearing 18, which rotatably supports the rotating shaft 4, is provided on the upper surface of the cylinder 11.

Figure 2:
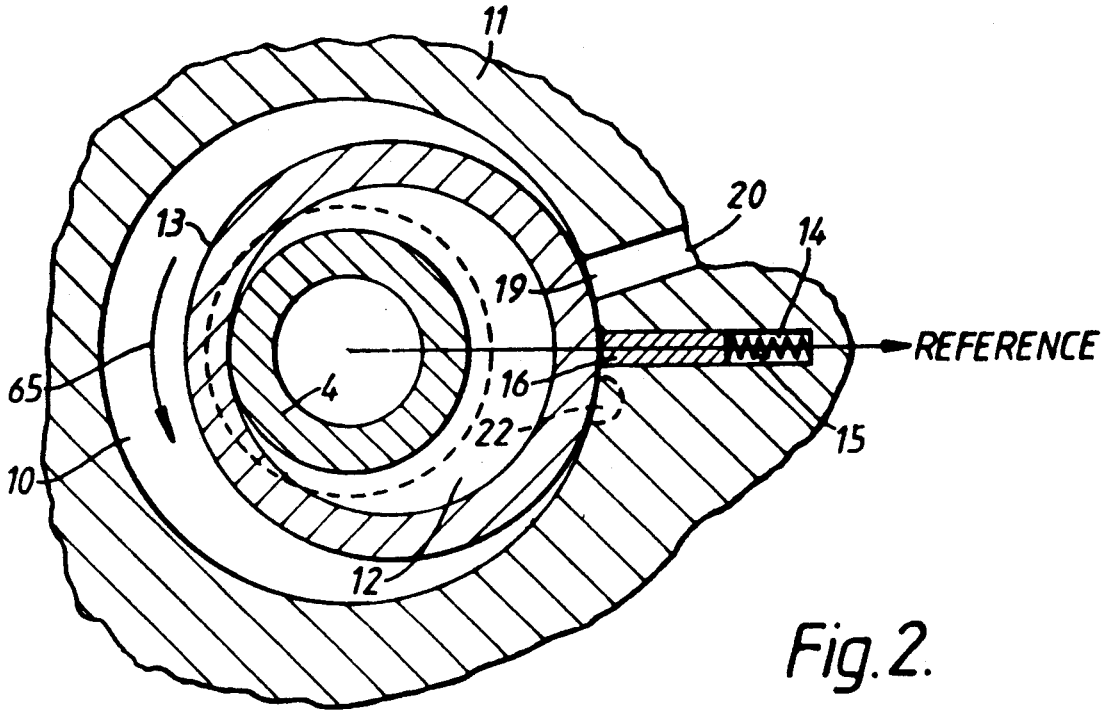
FIGS. 2 and 4 are partial sectional views taken in the direction of the arrows substantially along the line II—II of FIG. 1.

In FIG. 2, a suction inlet 19 is provided at a position near the blade 16. The one end of the suction inlet 19 is opened to the cylindrical space 10. The suction inlet 19 is connected to a gas suction pipe 21 by way of a guide 20 formed in the cylinder 11 and a hole provided on the lower sidewall of the housing 1. Further, a discharge outlet 22 is provided near the blade 16. The suction inlet 19 and the discharge outlet 22 are provided on both sides of the blade 16 as shown in FIG. 2. The discharge outlet 22 communicates with the internal space of the housing 1 by way of a discharge valve 23.

The rotary compressor mechanism 6 is similarly constituted as follows. Specifically, in FIG. 1, a cylinder 31 is disposed in close contact on the lower surface of the partition plate 9. The cylinder 31 has a cylindrical space 30 at its center portion (refer to FIG. 3). The rotating shaft 4 passes through the cylindrical space 30. The outer circumferential surface of the cylinder 31 is securely fixed to the inner circumferential surface of the housing 1. An eccentric portion 32 is securely fixed to the outer circumferential surface of the rotating shaft 4 at a portion positioned within the cylindrical space 30. The eccentric portion 32 and the eccentric portion 12 are respectively in phases shifted by 180 degrees from each other. A ring-shaped piston 33 is fitted with the outer circumferential surface of the eccentric portion 32. Further, a guide groove 34 is provided inphase with the guide groove 14. The one end of the guide groove 34 is opened to the cylindrical space 30. A blade 36 is fitted with the guide groove 34. The blade 36 is always energized by a spring 35 in the direction of the rotating shaft 4. Moreover, a flange portion 37 is provided on the lower surface of the cylinder 31. The flange portion 37 closes the lower opening of the cylindrical space 30. A journal bearing 38, which rotatably supports the rotating shaft 4, is provided on the lower surface of the cylinder 31.

Figure 3:
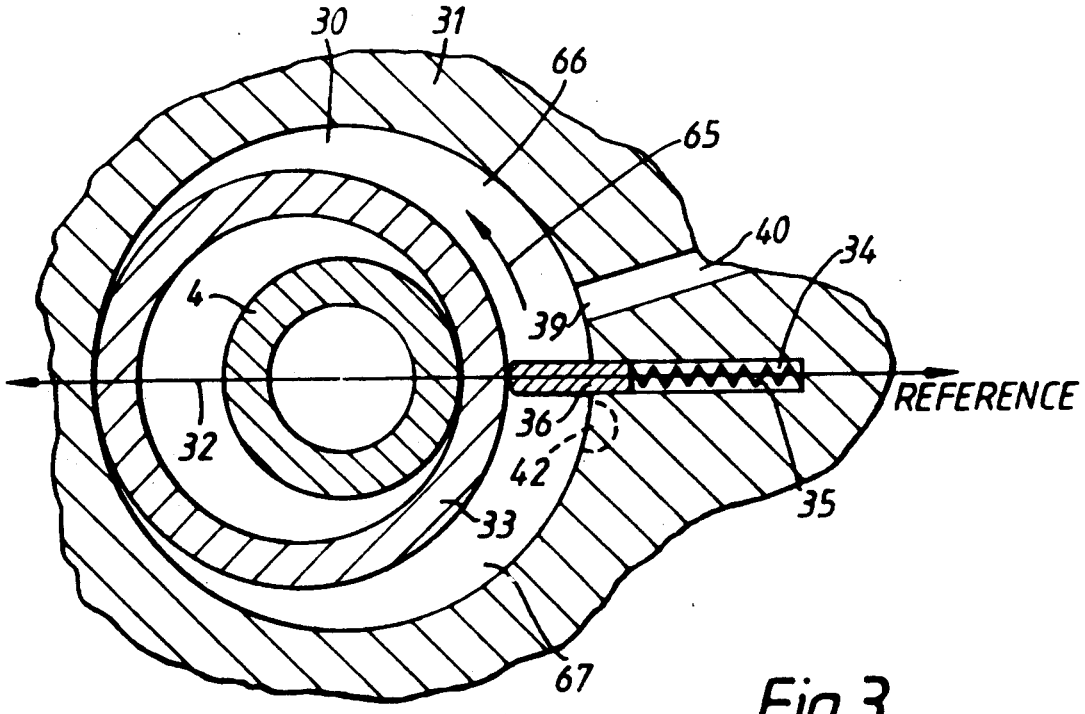
FIGS. 3 and 5 are partial sectional views taken in the direction of the arrows substantially along the line III—III of FIG. 1.
Figure 6:
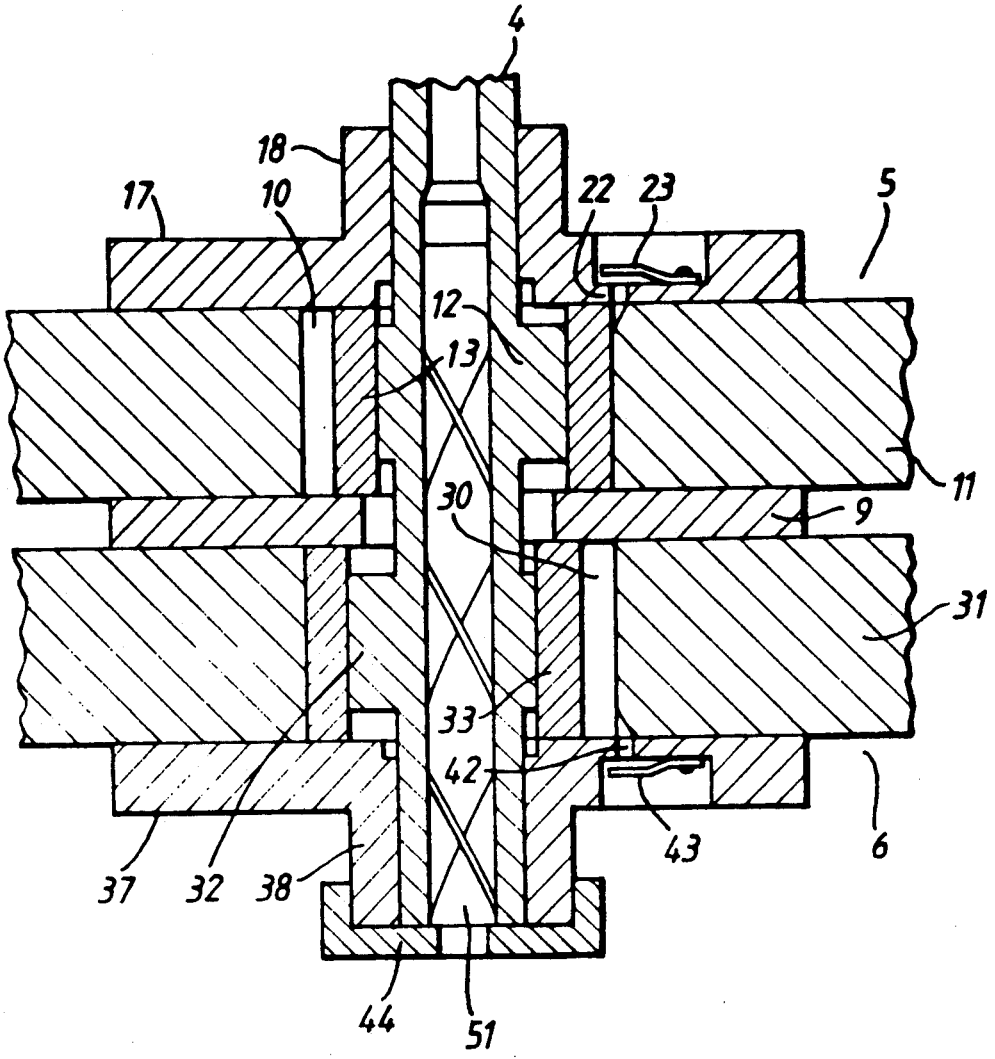
FIG. 6 is a longitudinal sectional view taken at an angle different from that of FIG. 1, partially illustrating the rotary compression mechanisms of the present invention.

On the other hand, as shown in FIG. 3, a suction inlet 39 is disposed near the blade 36. The one end of the suction inlet 39 is opened to the cylindrical space 30. The suction inlet 39 is connected to the gas suction pipe 21 by way of a guide 40 formed within the cylinder 31 and a hole provided on the lower sidewall of the housing 1. Further, a discharge outlet 42 is provided near the blade 36. The suction inlet 39 and the discharge outlet 42 are provided on both sides of the blade 36. The discharge outlet 42 communicates with the internal space of the housing 1 by way of the discharge valve 43 (refer to FIG. 6).

In FIG. 1, the journal bearings 18 and 38 support the radial load of the rotating shaft 4. The thrust load of the rotating shaft 4 is supported by a thrust bearing 44 provided at the lower side of the journal bearing 38. The rotating shaft 4 is formed with a hollow core. The core formed in the rotating shaft 4 has a larger diameter in the portion lower than the rotor 3. A plurality of vanes 51 are provided in the core of larger diameter. The vanes 51 draw lubricating oil 7 by a screw pump action. The vanes 51 are made of a belt-shaped plate material twisted in the direction of rotation of the rotating shaft 4. A lubricating bore 52 is provided at a portion which is on the circumferential wall of the rotating shaft 4 and is at a boundary of the journal bearing 18 and the cylinder 11. A lubricating bore 53 is provided at a portion which is on the circumferential wall of the rotating shaft 4 and is at a boundary of the journal bearing 38 and the cylinder 31. The lubricating bores 52 and 53 respectively introduce the lubricating oil 7 drawn upward by the vanes 51 into the journal bearings 18 and 38.

Figure 7:
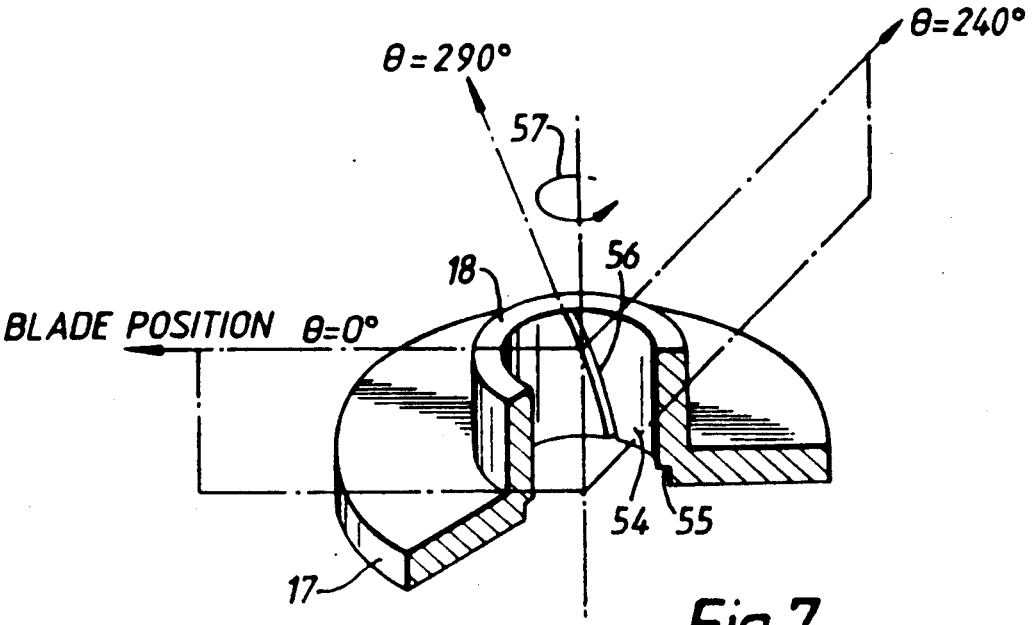
FIG. 7 is a partially cut-away perspective view illustrating a journal bearing disposed at a position near an electric motor.

The journal bearing 18 has, as shown in FIG. 7, an annular step portion 55 on its inner surface 54 at an edge portion positioned on the side of the cylinder 11. The annular step portion 55 extends in the circumferential direction. The journal bearing 18 also has an oil-guiding groove 56 on its inner surface 54. The oil-guiding groove 56 extends in the axial direction while extending also in the rotational direction of the rotating shaft 4. In this embodiment, when the rotational direction of the rotating shaft 4 is assumed in a direction indicated by the solid-linearrow 57 shown in FIG. 7, the oil-guiding groove 56 is formed as follows. Specifically, the groove 56 is formed in a range of 240 to 290 degrees in the rotational direction of the rotating shaft 4, wherein the position of the blade 16 is assumed to be 0 degrees.

Figure 8:
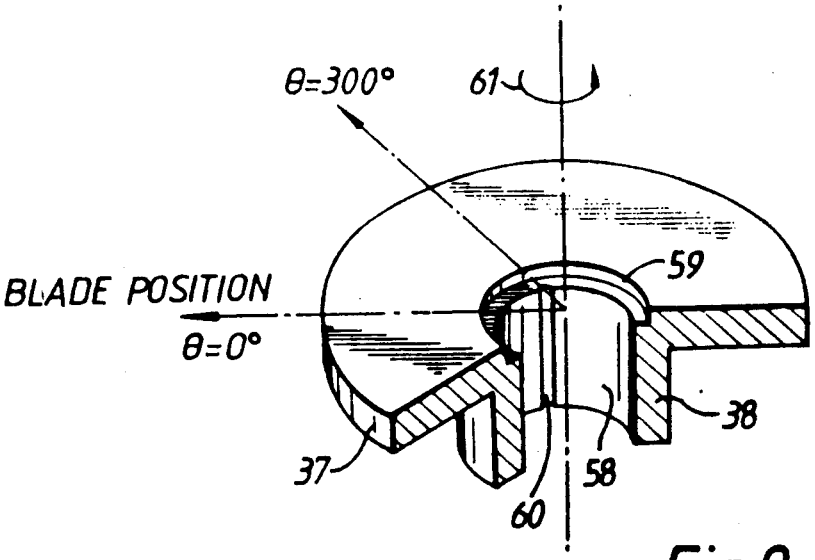
FIG. 8 is a partially cut-away perspective view illustrating a journal bearing disposed at a position separated from the electric motor.

On the other hand, the journal bearing 38 has, as shown in FIG. 8, an annular step portion 59 on its inner surface 58 at an edge portion positioned on the side of the cylinder 31. The annular step portion 59 extends in the circumferential direction. The journal bearing 38 also has an oil-guiding groove 60 on its inner surface 58. The oil-guiding groove 60 extends linearly in the axial direction. In this embodiment, when the rotational direction of the rotating shaft 4 is assumed in a direction indicated by the solid-line arrow 61 shown in FIG. 8, the oil-guiding groove 60 is formed as follows.

Specifically, the groove 60 is formed at a position of 300 degrees in the rotational direction of the rotating shaft 4, wherein the position of the blade 36 is assumed to be 0 degrees. In FIG. 1, the upper and lower spaces between the rotary compression mechanisms 5 and 6 communicate with each other by way of a passage 62. A gas-exhausting pipe 63 exhausts a high-pressure gas. A power supply apparatus 64 serves to supply power to the electric motor 2.

Next, the operations of the above-described rotary compressor will be described.

When the electric motor 2 is energized, the rotor 3 rotates, and then the rotating shaft 4 starts to rotate. Thus, the pistons 13 and 33 of the respective rotary compression mechanisms 5 and 6 rotate eccentrically. As shown in FIGS. 2 and 3, the tip portions of the blades 16 and 36 are always in sliding contact with the respective outer circumference surfaces of the pistons 13 and 33. The cylindrical spaces 10 and 30 respectively communicate with the suction inlets 19 and 39, and the discharge outlets 22 and 42 with the blades 16 and 36 interposed therebetween. When the pistons 13 and 33 rotate in the direction indicated by the solid-line arrow 65 as shown in FIGS. 2 and 3, a suction chamber 66 and a compression chamber 67 are formed in the respective cylindrical spaces 10 and 30. This is because the blades 16 and 36 are always partitioning the spaces 10 and 30, respectively.

A gas compressed by the respective compression chambers 67 is discharged into the space within the housing 1 by way of the discharge outlets 22 and 42, respectively. In this case, the pistons 13 and 33 are eccentrically disposed with a phase difference of 180 degrees, while the blades 16 and 36 are disposed in-phase. Thus, when the piston 13 starts the compression process, the piston 33 has already ended a half of the compression process. Therefore, while the rotating shaft 4 rotates by one revolution, a compressed gas is discharged twice into the space within the housing 1. Thereafter, the high-pressure gas within the housing 1 is introduced into necessary apparatus by way of the gas-exhausting pipe 63.

In the above-described compression process, the lubrication between the journal of the rotating shaft 4 and the journal bearings 18 and 38 is performed as follows. Lubricating oil 7 stored in the bottom portion of the housing 1 is drawn by the screw pump action of the vane 51 into the upper portion within the rotating shaft 4. The thus drawn lubricating oil 7 flows into the annular step portions 59 and 55 formed at the edge portions of the inner surfaces 58 and 54 of the journal bearings 38 and 18 by way of the lubricating bores 53 and 52. The oil-guiding groove 60 is formed on the inner surface 58 of the journal bearing 38 linearly in the axial direction of the rotating shaft 4 as shown in FIG. 8. Thus, the lubricating oil 7 that flowed into the annular step portion 59 flows down within the oil-guiding groove 60. The lubricaitng oil 7 that flows down within the oil-guiding groove 60 spreads throughout the inner surface 58 of the journal bearing 38 due to the rotation of the rotating shaft 4.

As a result, an annular oil film is formed between the journal of the rotating shaft 4 and the inner surface 58 of the journal bearing 38. On the other hand, the oil-guiding groove 56 is formed on the inner surface 54 of the journal bearing 18 in a direction which the rotating shaft 4 rotates. Thus, the lubricating oil 7 that flowed into the annular step portion 55 moves upward within the oil-guiding groove 56 by the relative movement of the rotating shaft 4 and the journal bearing 18. As a result, the lubricating oil 7 spreads throughout the inner surface 54 of the journal bearing 18. Thus, the oil film is formed between the journal of the rotating shaft 4 and the inner surface 54 of the journal bearing 18.

Figure 9:
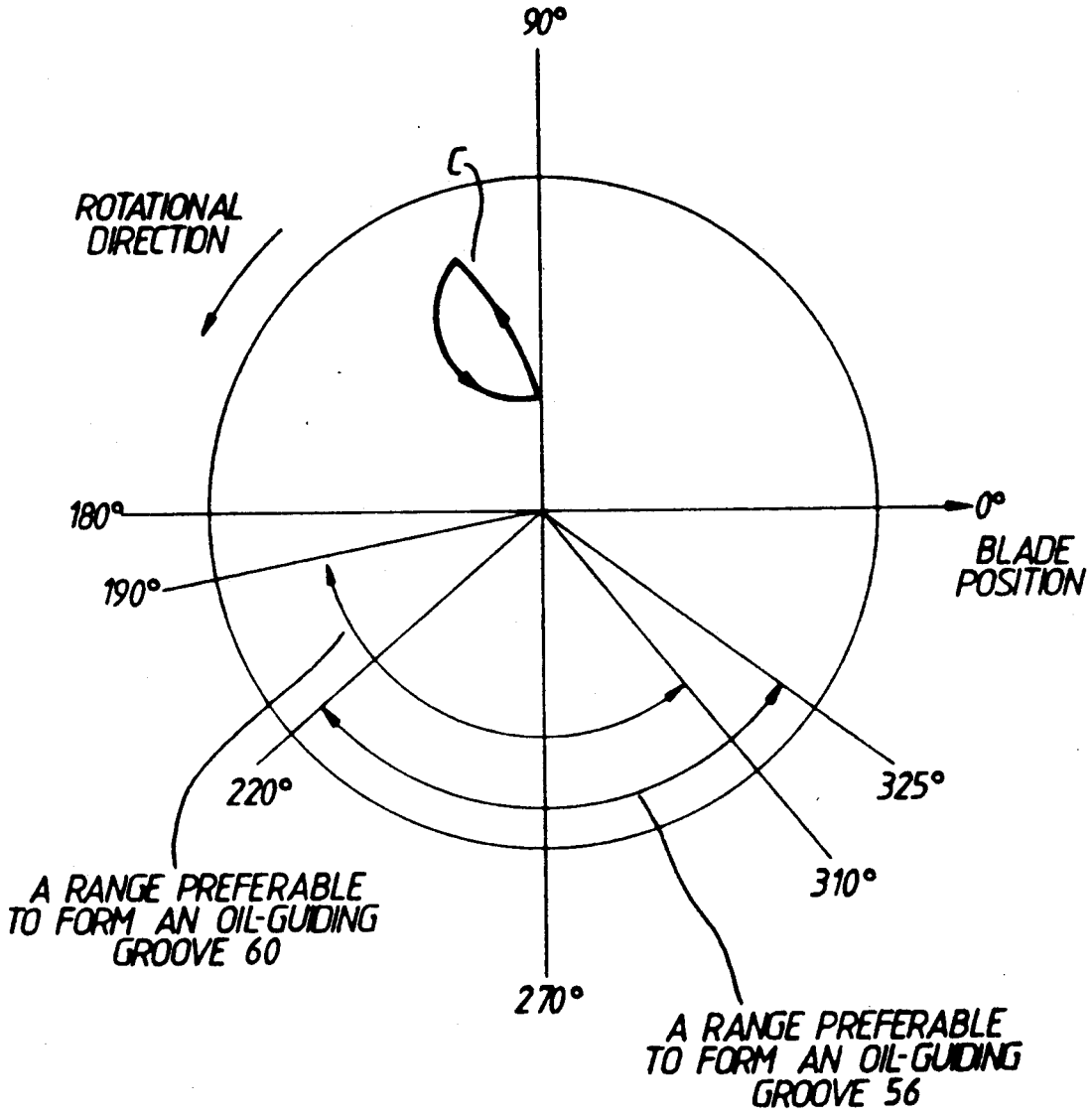
FIG. 9 is a diagram for explaining a load acting on the journal bearing, and preferable positions at which oil-guiding grooves are disposed according to the present invention.

In the case of two-cylinder type, the pistons 13 and 33 are securely fixed to the rotating shaft 4 with a phase difference of 180 degrees. Thus, the presence of the pistons 13 and 33 reduces the rotational unbalance that acts on the rotating shaft 4 to a relatively small value. However, the pressure difference between compressed gases and suction gases acts significantly on the rotating shaft 4 with a force as shown in C of FIG. 9. Even when the pressure difference is developed in a direction acting on the rotating shaft 4, if the oil-guiding grooves 56 and 60 of the journal bearings 18 and 38 are disposed at angles in a range described above, the necessary lubrication can be securely made. As a result, damage to the rubbing surface of the bearings can be prevented.

Hereinafter, the reason for this will be described. The inventors examined the reason by way of experiment as follows. When the above-described pressure difference is acted on the rotating shaft 4, changes in the oil film pressure within the journal bearings 18 and 38 in the circumferential direction were examined. Specifically, 12 pressure sensors were attached to the outer circumferential surface of the journal bearing 18, on the side near the motor 2 with a separation interval of 30 degrees.

Similarly, 12 pressure sensors were attached to the outer circumferential surface of the journal bearing 18, on the side near the cylinder 11 with a separation interval of 30 degrees. Further, 12 pressure sensors were also attached to the outer circumferential surface of the journal bearing 38, on the side near the cylinder 31 with a separation interval of 30 degrees. These 36 pressure sensors respectively communicated with the inner surfaces of the journal bearings 18 and 38 by way of small holes which were particularly made for this experiment. Thereafter, the pressure distribution in the circumferential direction of the oil films on the inner surfaces of the journal bearings 18 and 38 were actually measured.

Figure 10:
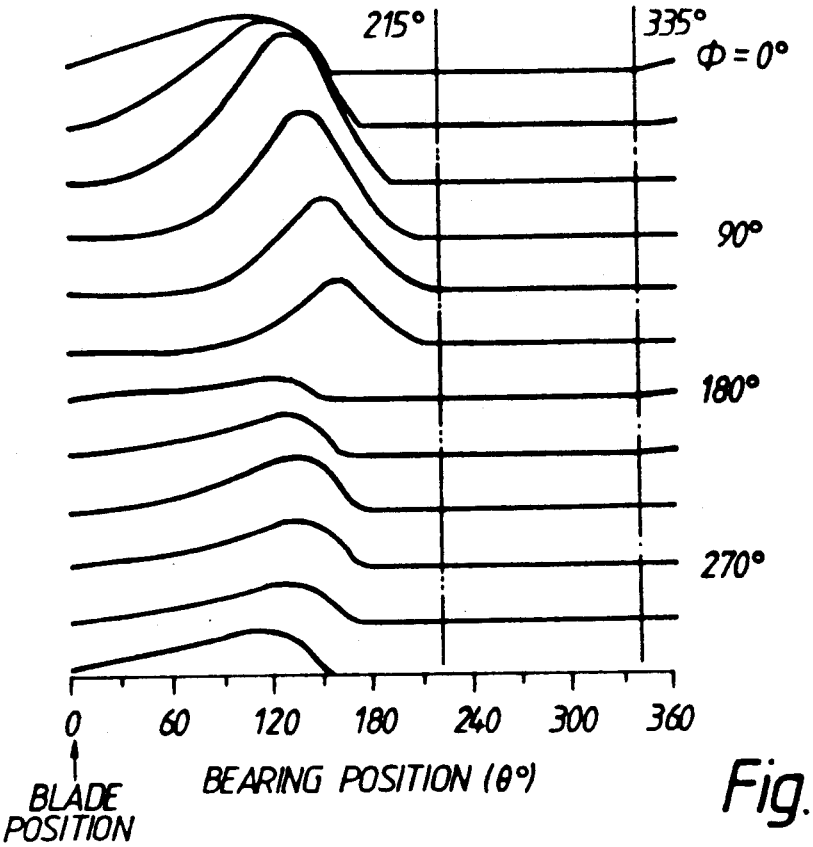
FIGS. 10 through 12 are graphs illustrating the experimental results from which the preferable positions of the oil-guiding grooves are derived.
Figure 11:
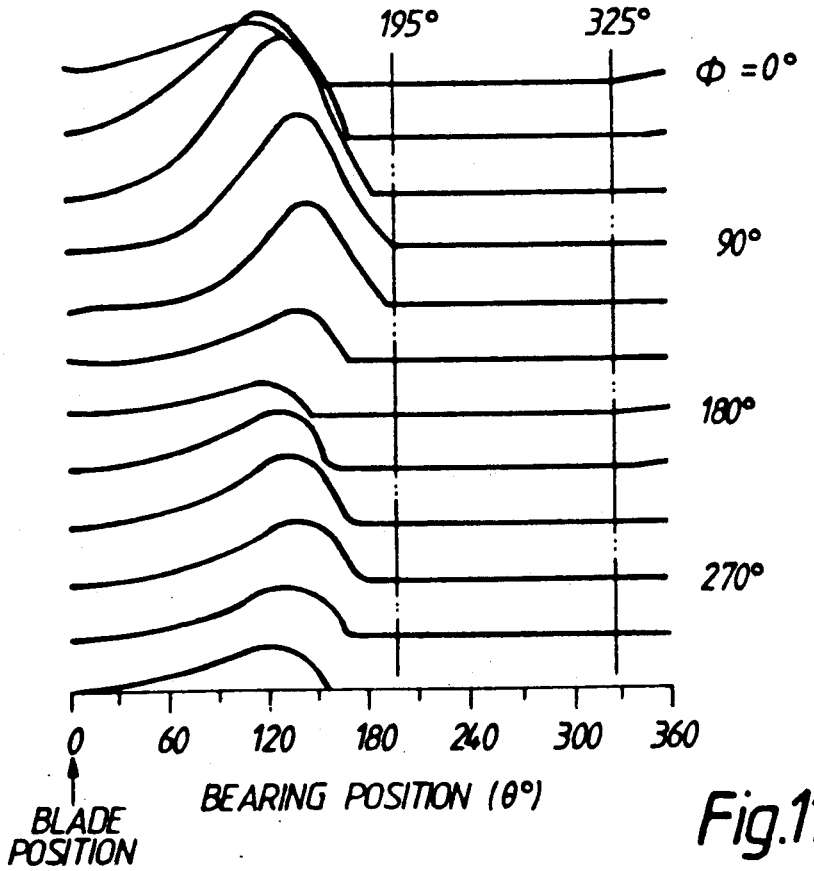
Figure 12:
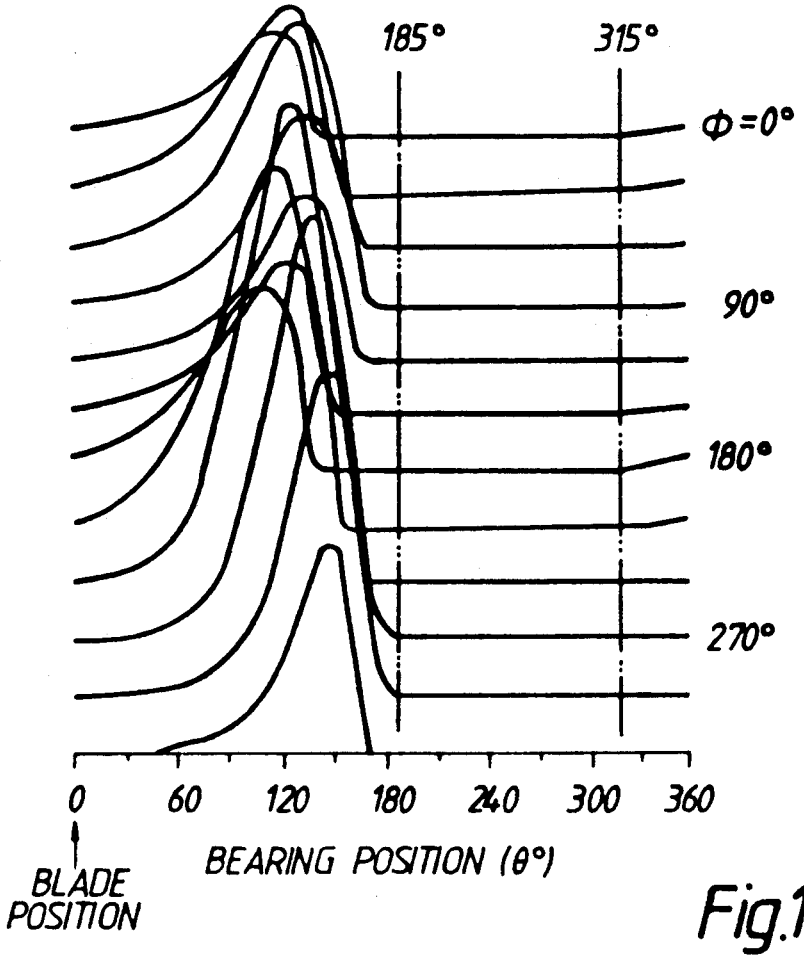

As a result, the characteristics shown in FIGS. 10 through 12 were obtained. Here, FIG. 10 shows the characteristics obtained at the portion near the motor 2 of the journal bearing 18. FIG. 11 shows the characteristics obtained at the portion near the cylinder 11 of the journal bearing 18. FIG. 12 shows the characteristics obtained at the portion near the cylinder 31 of the journal bearing 38. In FIGS. 10 through 12, the respective abscissas represent the circumferential positions of the journal bearings when the positions of the blades 16 and 36 are assumed to be 0 degrees. The ordinates represent the pressure distribution in the circumferential directions. Here, the position at which the piston 13 pushed the blade 16 innermost is assumed to be a rotation angle $\phi=0$ degrees.

Namely, these graphs show the pressure distribution characteristics in the circumferential direction at every 30-degree interval during one revolution of the rotating shaft 4. The portions of straight lines of the pressure distributions indicate that the inner portions of the bearings are at negative pressures with respect to the outer portions of the bearings. As can be seen from these graphs, in the journal bearing 18 (FIGS. 10 and 11), no pressure rises appear in a range of 215 to 330 degrees, i.e., negative pressure regions are obtained in this range. Similarly, in the journal bearing 38, (FIG. 12), a negative pressure region is obtained in a range of 185 to 315 degrees.

These differences are caused by the differences in the whirling characteristics of the rotating shaft 4 having the rotor 3 at the one side. The lubricating oil 7 can easily flow into the inner surface of the journal bearing which is in a negative pressure region. In the embodiments described with reference to FIGS. 1 through 8, the oil-guiding groove 56 is formed at a position within the range of 240 to 290 degrees in the case of the journal bearing 18. Further, the oil-guiding groove 60 is formed at a position of 300 degree in the case of the journal bearing 38. Therefore, the lubricating oil 7 can be securely put into the gap between the journal of the rotating shaft 4 and the inner surfaces 54 and 58 of the journal bearings 18 and 38.

As a result, direct contact between the journal of the rotating shaft 4 and the inner surfaces 54 and 58 of the journal bearings 18 and 38 can be securely prevented. Moreover, the pressures of oil films in the vicinity of the oil-guiding grooves 56 and 60 are always maintained at the negative pressure during each revolution of the rotating shaft 4. Thus, the lubricating oil 7 can be positively introduced into the entire inner surfaces of the journal bearings 18 and 38.

Further, in this embodiment, the annular step portions 55 and 59 are formed on the inner surfaces 54 and 58 of the journal bearings 18 and 38 at positions opposite to the lubricating bores 52 and 53. Thus, the lubrication performance can be significantly enhanced.

In addition, the positions of the oil-guiding grooves 56 and 60 in the journal bearings 18 and 38 are not limited to the range of 240 to 290 degrees and 300 degrees, respectively. However, they may also be in the range of 220 to 325 degrees, and in the range of 190 to 310 degrees, respectively, in considering the misalignment generated on assembling two journal bearings 18 and 38.

Next, a second embodiment of this invention, in which objectionable noise and vibrations from the rotary compressor can be significantly reduced, will be described. Specifically, here, the phase difference between the gas compression processes of two compression mechanisms is shifted from $\pi$ ($\pi=180$ degrees, the phase difference in the first embodiment). Thus, load torque fluctuations and gas discharge pulsation do not occur at regular intervals. As a result, the vibration component of $2f_s$Hz decreases.

Figure 13:
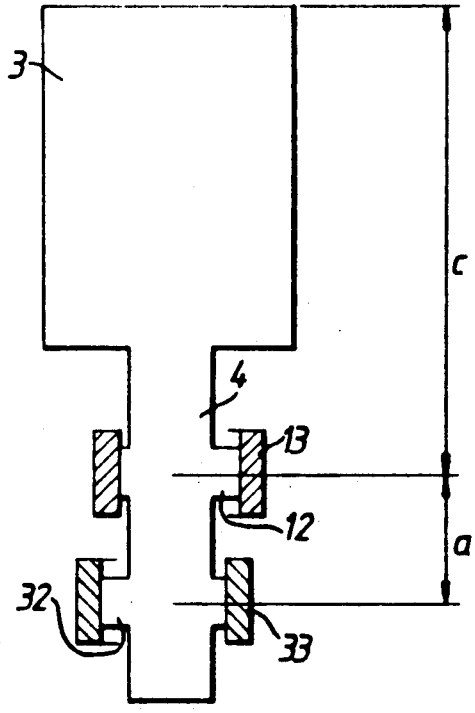
FIG. 13 is a conceptional diagram illustrating the relative dimensions of the rotary compression mechanisms of the present invention.

FIG. 13 is a schematic diagram illustrating a two-cylinder type rotary compressor according to the second embodiment of the present invention. In FIG. 13, the axial distance between two pistons 13 and 33 is defined as "a". Further, the axial distance between the upper end of a rotor 3 and the piston 13 near the rotor 3 is defined as "c". The axial distances "a" and "c" are respectively determined as follows;

$a=21$ mm, $c=140$ mm.

Figure 4:
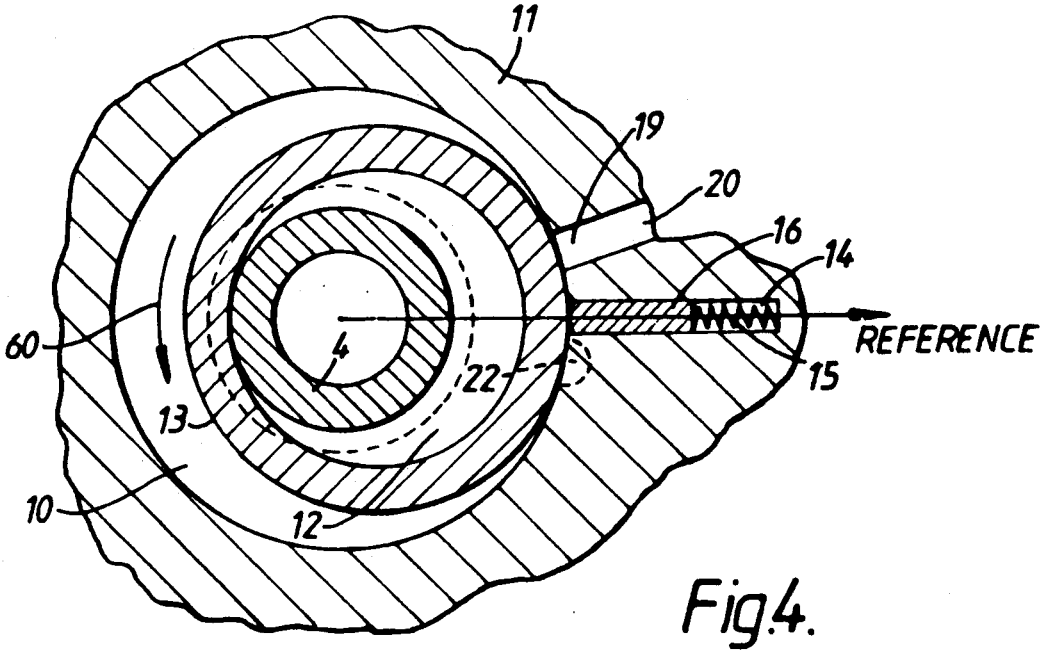
Figure 5:
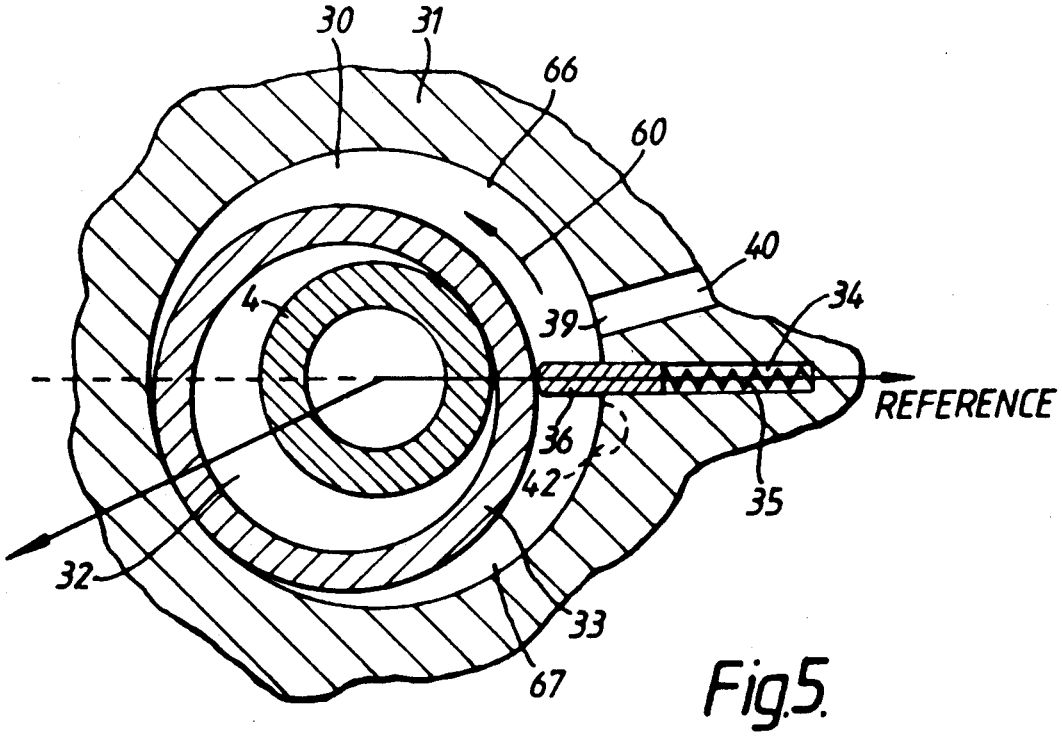

Here, two rotary compressor mechanisms 5 and 6 are disposed with a phase difference, which will be described hereinafter. Specifically blades 16 and 36 of the respective rotary compressor mechanisms 5 and 6 are disposed in the in-phase relation. Here, the eccentric direction of the piston 13 is defined as a reference as shown in FIG. 4. The pistons 13 and 33 are rigidly fixed to the rotating shaft 4 such that the eccentric direction of the piston 33 has a phase difference of 165 degrees in a counter rotational direction with respect to the rotational direction of the rotating shaft 4 as shown in FIG. 5.

As a result, two eccentric portions 12 and 32 have the same phase difference as described above. Therefore, the rotary compression mechanisms 5 and 6 are determined to have the phase of compression process as follows. Specifically, when the rotating shaft 4 rotates by an angle of 165 degrees from the starting point of compression of the rotary compression mechanism 5, the rotary compression mechanism 6 starts the compression process.

Next, the operation of the above-described rotary compressor will be described with reference to FIGS. 4 and 5.

When the motor 2 is energized, the rotor 3 rotates and then the rotating shaft 4 starts to rotate. As a result, the pistons 13 and 33 of the respective rotary compression mechanisms 5 and 6 rotate eccentrically. The tip portions of the blades 16 and 36 are always in slidable contact with the outer circumferential surfaces of the pistons 13 and 33. The respective cylindrical spaces 10 and 30 communicate with suction inlets 19 and 39, and discharge outlets 22 and 42 that border across the blades 16 and 36. Therefore, when the pistons 13 and 33 rotate in a direction indicated by the solid-line arrow 60, the respective spaces 10 and 30 are partitioned by the blades 16 and 36.

Thus, as shown in FIG. 5 a suction chamber 66 is formed on the upper side, and a compression chamber 67 is formed on the lower side. The gases compressed by the respective chambers 67 are discharged by way of the discharge outlets 22 and 42, and discharge valves 23 and 43 into the space within a housing 1. In this case, the pistons 13 and 33 are disposed eccentrically with a phase difference as described above. Further, the blades 16 and 36 are disposed in-phase. Thus, when the piston 13 starts the compression process, the piston 33 has already ended more than half of the compression process. Therefore, compressed gas is discharged twice into the space within the housing 1 during one revolution of the rotating shaft 4. The compressed high pressure gas is introduced into necessary apparatus by way of a gas-exhausting pipe 63.

The beat generated during the compression process, which has been a problem as an objectionable sound, becomes insignificant. Further, the whirling of the rotor 3 which is the cause of vibrations is significantly reduced. Moreover, the loads of the bearings 18 and 38 are also reduced. Thus, a two-cylinder type compressor with low-vibration and low-noise can be realized.

Hereinafter, the reason for this will be described. In a rotary compressor, various loads including eccentric loads act radially and positively on the rotating shaft 4. These loads are mainly such forces as follows: (1) a centrifugal force caused by the eccentrically disposed pistons 13 and 33; (2) an unbalance force caused by balancers generally disposed at both upper and lower ends of the rotor 3 for the purpose of keeping unbalance forces caused by the pistons 13 and 33 in equilibrium; (3) a force caused by the pressure difference of compressed gases within the rotary compression mechanisms 5 and 6.

The rotating shaft 4 is subject to bending action caused by these loads. In particular, the rotor 3 is supported only at the one side thereof by the journal bearing 18. As a result, the rotor 3 is significantly whirled.

A two-cylinder type rotary compressor has a rotation balance better than a one-cylinder type rotary compressor. Further, a balancer disposed for load equilibrium is relatively smaller than that of a one-cylinder type rotary compressor. As a result, unbalanced components are fewer and the amount of whirling is smaller as compared to a one-cylinder type rotary compressor. However, a two-cylinder type rotary compressor is more susceptible to the pressure difference of the compressed gases within the respective two compression mechanisms. Thus, the whirling of a rotor and a rotating shaft becomes complicated.

Therefore, the inventor examined the following by experiment and analysis. Specifically, changes in the whirling and the bearing load characteristics of the rotor 3 and the rotating shaft 4 when the phase difference between the compression processes of the respective rotary compression mechanisms 5 and 6 is changed were studied.

Figure 14:
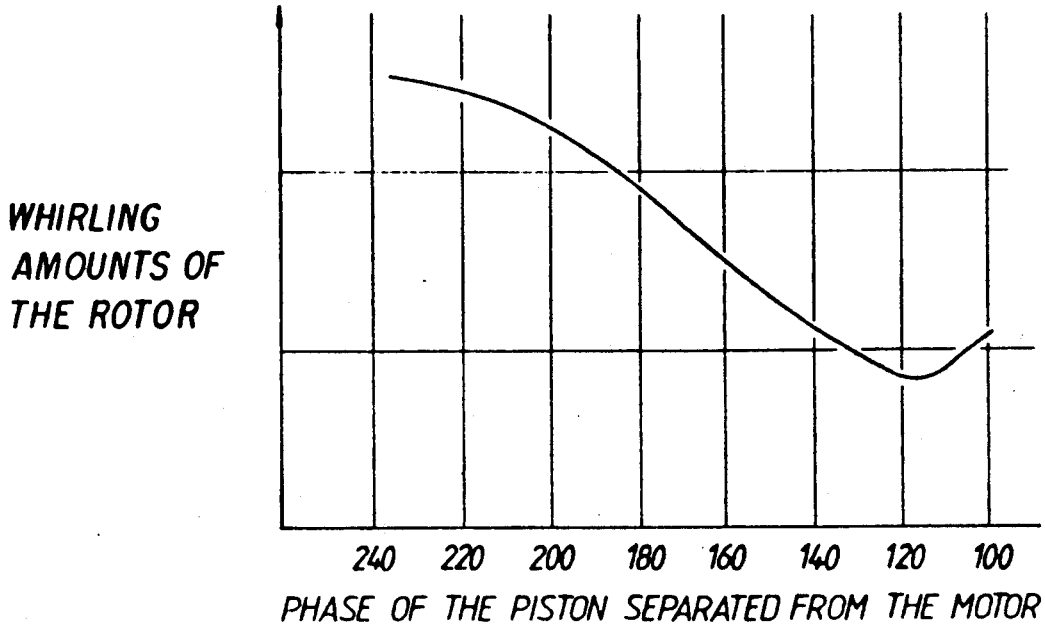
FIGS. 14 and 15 are graphs illustrating experimental results from which specified phase ranges are derived according to the present invention.
Figure 15:
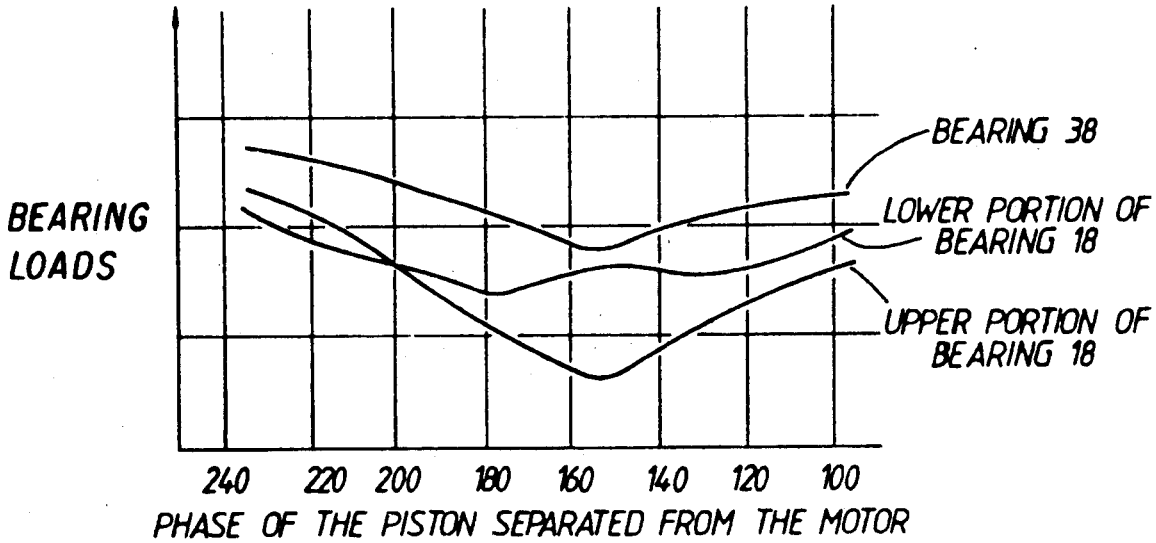

The phases of the blades 16 and 36 of the rotary compression mechanisms 5 and 6 were caused to coincide with each other. The phase differences of the eccentric portions 12 and 32, i.e., of the pistons 13 and 33 were changed into various angles. Under these conditions, the two-cylinder type rotary compressor was operated. Then, the amount of whirling of the upper side of rotor 3, i.e., how much the central axis of rotor 3 was off-centered from the central axis of the rotation, was measured by the use of a displacement meter. Further, the bearing loads of the journal bearings 18 and 38 were analytically examined in accordance with rotor model analysis. The results are shown in FIGS. 14 and 15. The respective abscissas represent the phase shift of the piston 33 in a direction opposite to the rotational direction of the rotating shaft 4. (where the phase of the piston 13 near the motor 2 is defined as a reference)

In FIG. 14, the ordinate represents the amount of whirling of the upper end of rotor 3. When the phase difference becomes greater than 180 degrees, the amount of whirling increases. When the phase difference becomes smaller, the amount of whirling decreases. The minimum value is present in the vicinity of 115 degrees. In FIG. 15, the ordinate represents the amount of bearing loads of the journal bearings 18 and 38. The minimum values in the cases of the journal bearing 38 and the upper portion of the journal bearing 18 are respectively in the vicinity of 155 degrees. The minimum value in the case of the lower portion of the journal bearing 18 is present at about 180 degrees.

The inventor discovered that in the two-cylinder type rotary compressor, when the phase difference between the pistons 13 and 33 was changed, the above-described changes in dynamic characteristics occurred.

In other words, the phase of the piston 13 near the motor 2 is defined as a reference, and then the phase difference of the piston 33 in a direction opposite to the rotational direction of the rotating shaft 4 is determined to be less than 180 degrees. As a result, the whirling characteristics of the rotor 3 and the rotating shaft 4 become satisfactory. In addition, the bearing loads of the journal bearings 18 and 38 decrease. However, the reduction of the phase difference of the piston 33 with respect to the piston 13 is inevitably limited. This is because the smaller the phase difference, the greater the vibration in the rotational direction of the entire rotary compressor. The vibration of the rotational direction is basically determined by the amount of torque fluctuation caused by the pressure difference of the compressed gases. The amount of torque fluctuation becomes a minimum when the phase difference between the pistons 13 and 33 is present at about 180 degrees. Thus, the vibration in the rotational direction becomes a minimum when the phase difference between the pistons 13 and 33 is present at about 180 degrees. On the other hand, the vibration in the radial direction is caused by the above-described amount of whirling of the rotor 3 and the rotating shaft 4.

Therefore, an appropriate phase difference between the pistons 13 and 33 is determined depending on a satisfactory balance of the vibration in the rotational direction and the vibration in the radial direction. In FIG. 14, the minimum amount of whirling is present in the vicinity of 115 degrees. However, If the phase difference between the pistons 13 and 33 is determined to be about 115 degrees only because of this result, the vibration of the rotational direction would become significantly greater. Thus, satisfactory results cannot be obtained. In light of this, the optimum value of the phase difference between the pistons 13 and 33 could be in the vicinity of 150 degrees. This is the value shown in FIG. 15 as the minimum value of the bearing load of the journal bearing 38 and the upper portion of the journal bearing 18. Specifically, an appropriate range of the phase difference between the pistons 13 and 33 is a range of 150 to 180 degrees. Therefore, in this embodiment, the phase difference therebetween is determined to be about 165 degrees. In the range of 150 to 180 degrees, the increase of the vibrations of the rotational direction is significantly small. In addition, the vibrations of the radial direction become smaller than those in the case when the phase difference between the pistons 13 and 33 is about 180 degrees. Moreover, the bearing loads thereof can also be reduced.

The above-described optimum range of the phase difference between two pistons is changed depending on the sizes of two-cylinder type rotary compressors. This fact was also confirmed by the inventor.

In general, two balancers disposed on both the upper and lower sides of the rotor 3 have an optimum mass and amount of eccentricity. These values are determined on the basis of the relationship between force and moment in equilibrium. The optimum amounts of mass and eccentricity of the balancers are necessary to compensate the unbalanced loads of the pistons 13 and 33. The mass and eccentricity change their optimum values when the phase difference between the pistons 13 and 33 is changed. Further, the optimum eccentric directions of the balancers may change independently. Hereinafter, the mass of balancers and the phase of attaching positions will be obtained on the basis of certain calculations.

Figure 16:
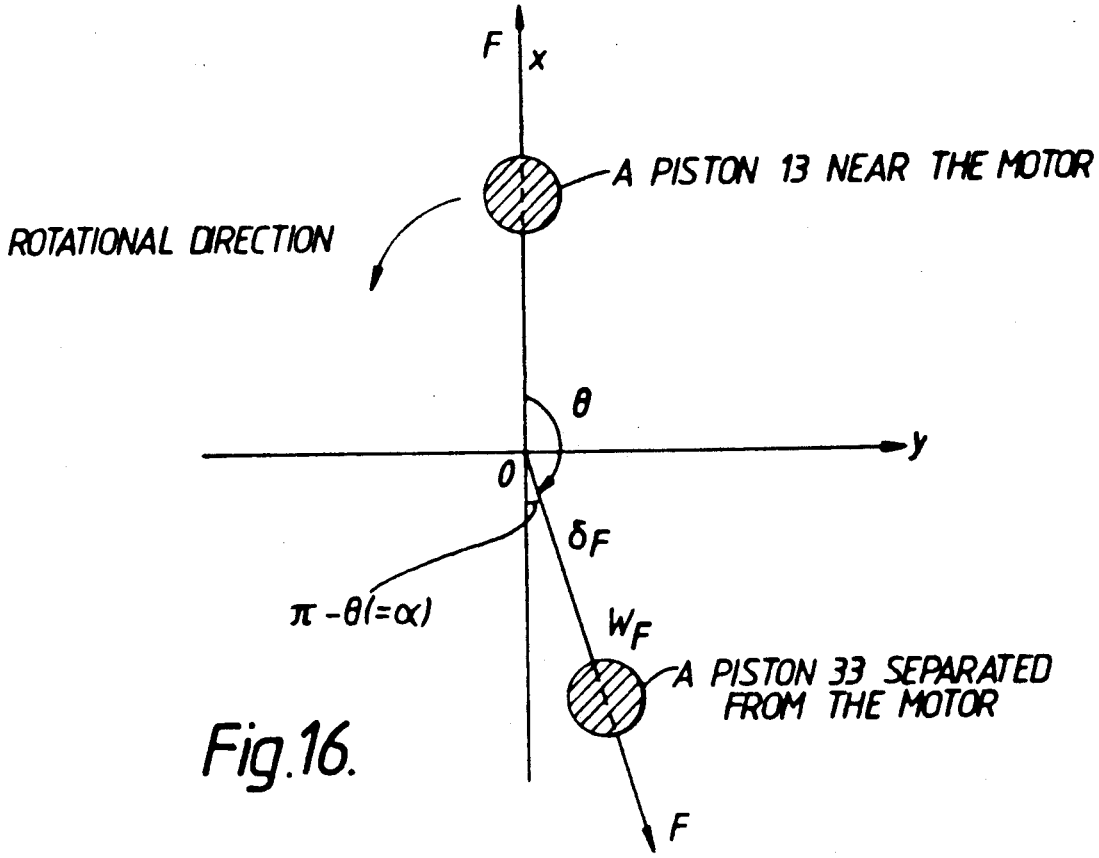
FIG. 16 is a schematic diagram for defining a coordinate system of the rotary compression mechanisms according to a second embodiment of the present invention.
Figure 17:
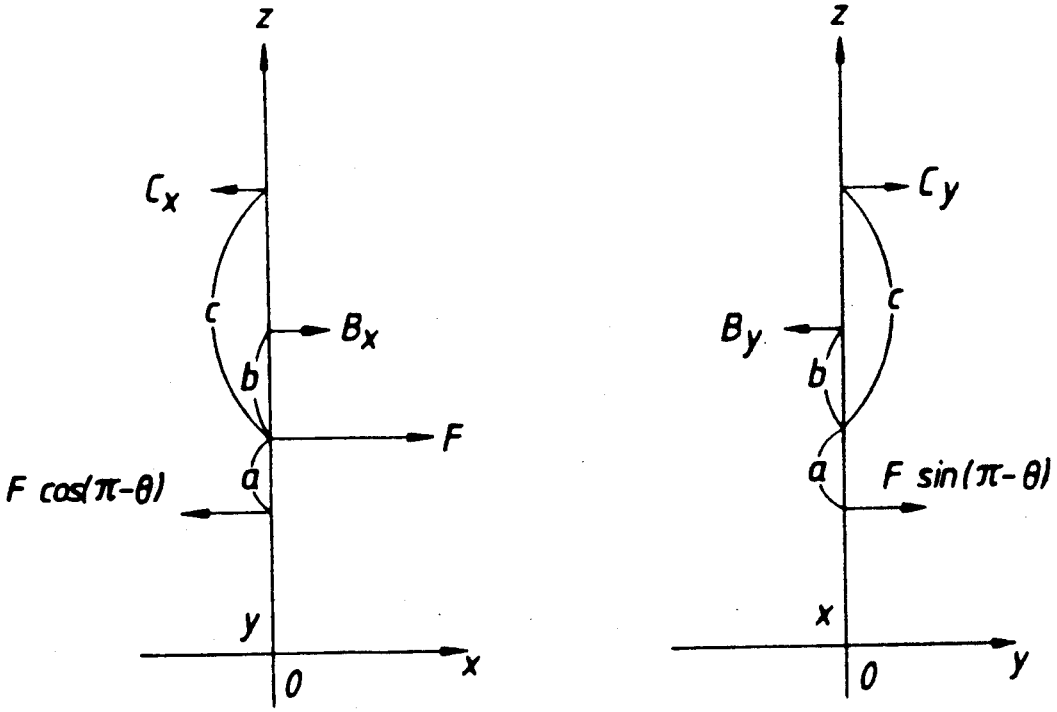
FIGS. 17 and 18 are schematic diagrams illustrating balancing states of the rotating shaft according to the present invention.

FIG. 16 is a schematic diagram for defining a coordinate system of the rotary compressor system in this embodiment. In FIG. 16, the x-axis positive direction represents the direction of the blades 16 and 36 with respect to the rotational center. The y-axis positive direction represents a direction of the rotational angle —90 degrees of the rotating shaft 4 with respect to the rotational center. The z-axis represents the axial direction of the rotating shaft 4. As shown in FIG. 14, when the phase difference between the pistons 13 and 33 is $\theta$, the equilibrium of the rotating shaft 4 becomes those as shown in FIGS. 17(*a*) and 17(*b*). In the derivations below the following abbreviations apply.

g: gravitational acceleration, $\omega$: rotational angular velocity,

F: unbalanced forces induced by the eccentric rotation of the eccentric portions 12, 32, and the pistons 13, 33, $W_F$: weight of the eccentric portions 12, 32 and the pistons 13, 33, $\delta_F$: distance between the center of gravity of the eccentric portions and the center of the piston shaft.

From the equilibrium of force and the equilibrium of moment, the following equations can be obtained. In the equilibrium of force equation, $\omega$ and g are equal and can be eliminated.

It is assumed that $F=\delta_F/g\times\delta_F\omega^2$;

(i) As to the x-z plane; the equation of equilibrium of force $$B_x-C_x+F-F\cos(\pi-\theta)=0 \quad (1)$$

the equation of equilibrium of moment $$bB_x-cC_x+aF\cos(\pi-\theta)=0 \quad (2)$$

(ii) As to the y-z plane; the equation of equilibrium of force $$C_y-B_y+F\sin(\pi-\theta)=0 \quad (3)$$

the equation of equilibrium of moment $$-bB_y+cC_y-aF\sin(\pi-\theta)=0 \quad (4)$$

where

B: eccentric loads of the balancer 70*a* attached to the lower side of the rotor as shown in FIG. 1.

C: eccentric loads of the balancer 70*b* attached to the upper side of the rotor as shown in FIG. 1.

a: distance between two pistons b: distance between the piston separated from the motor (i.e., lower side) and the balancer attached to the lower side of the rotor c: distance between the piston separated from the motor (i.e., lower side) and the balancer attached to the upper side of the rotor.

The following equations will be obtained from the above-described equations (1) through (4):

$$B_x=\frac{F}{c-b}[a\cos(\pi-\theta)+c\{\cos(\pi-\theta)-1\}] \quad (5)$$

$$C_x=\frac{F}{c-b}[a\cos(\pi-\theta)+b\{\cos(\pi-\theta)-1\}] \quad (6)$$

$$B_y=\frac{F}{c-b}(a+b)F\sin(\pi-\theta) \quad (7)$$

-continued $$C_y = \frac{F}{c-b}(a+b)F\sin(\pi-\theta) \quad (8)$$

Therefore, the following equations will be obtained.

$$W_C = \frac{1}{\delta_C}\sqrt{C_x^2 + C_y^2} \quad (9)$$

$$\theta_C = \tan^{-1}\left(\frac{C_y}{C_x}\right) \quad (10)$$

$$W_B = \frac{1}{\delta_B}\sqrt{B_x^2 + B_y^2} \quad (11)$$

$$\theta_B = \tan^{-1}\left(\frac{B_y}{B_x}\right) \quad (12)$$

where $W_C$: weight of the balancer attached to the upper side of the rotor $W_B$: weight of the balancer attached to the lower side of the rotor $\theta_C$: phase of attaching postion of the balancer having a weight of $W_C$ $\theta_B$: phase of attaching position of the balancer having a weight of $W_B$ $\delta_C$: amount of eccentricity of the balancer attached to the upper side of the rotor $\delta_B$: amount of eccentricity of the balancer attached to the lower side of the rotor In FIGS. 14 and 15, the respective minimum values are considered to be determined by the following factors such as;

radial loads acted on the pistons 13 and 33, unbalanced forces caused by the balancers attached on both the upper and lower end of the rotor 3, and magnitude or moment of rotational (whirling) inertia of the rotor 3

Therefore, it can be satisfactorily considered that the extremes of the respective curves in FIGS. 14 and 15 may be changed by the respective dimensions of rotary compressors.

Figure 18:
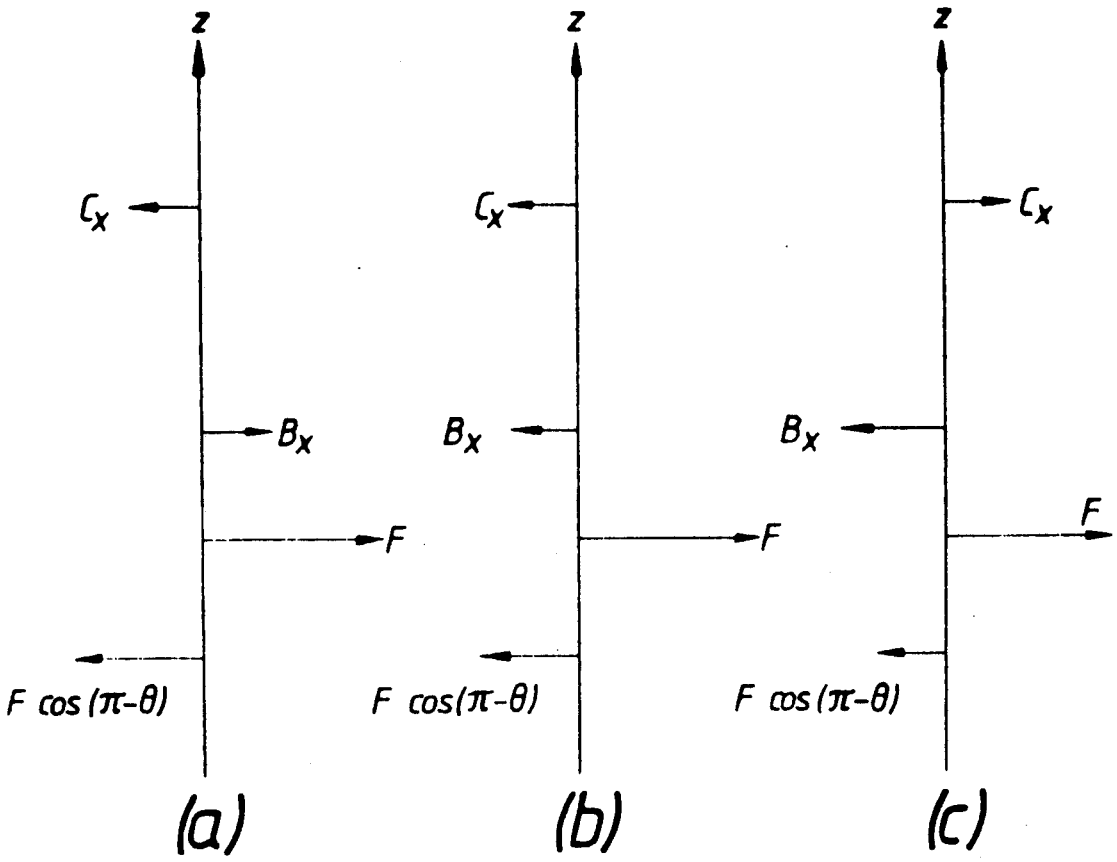

Here, the balancers attached to both the upper and lower sides of the rotor 3 are taken into consideration in order to obtain an optimum phase difference between the pistons 13 and 33 for the minimum values in FIG. 15. Now, a phase angle $\theta$ (phase difference) between the pistons 13 and 33 is considered within the range of 90 to 270 degrees. Then, the balancing state on the x-z plane shown in FIG. 17(*a*) may be classified into three different states such as shown in FIGS. 18(*a*), 18(*b*) and 18(*c*). However, the balancing state on the y-z plane has only one state shown in FIG. 17(*b*).

FIG. 18(*a*) shows the balancing state of the conventional two-cylinder type rotary compressor. FIG. 18(*b*) shows the balancing state of the two-cylinder type rotary compressor having a phase angle (phase difference) so large that the balancing state becomes substantially the same as that of a one-cylinder type rotary compressor. FIG. 18(*c*) shows the balancing state of the two-cylinder type rotary compressor having a phase angle (phase difference) of an intermediate value between those of FIGS. 18(*a*) and 18(*b*).

Here, it is assumed that $\pi-\theta$ shown in FIG. 16 is substituted for $\alpha$. Then, a value of $\alpha$ which is represented by $\pi-\theta=\alpha$ will be obtained hereinafter taking the respective dimensions of the rotary compressor into consideration. In the balancing state of FIG. 18(*a*), when $\theta=\pi\pm\alpha$, $B_x=0$ is obtained. Next, the relationship of $\pi-\theta=\alpha$ is rearranged by substituting $B_x=0$ into the equations (1) and (2). As a result, the following equation is obtained:

$$\alpha = \cos^{-1}\left(\frac{c}{c+a}\right) \quad (13)$$

In this embodiment, as described above, a=21 mm and c=140 mm are defined. Thus, $\alpha \simeq 30$ degrees is obtained.

Referring to FIG. 15, it can be confirmed that the extremes of the respective curves correspond substantially to $\theta=\pi-\alpha=150$ degrees.

It is obvious that the characteristics shown in FIGS. 14 and 15 have connections with the above-described $\alpha$. Moreover, the relationship expressed by the equation (13) holds even in any of two-cylinder type rotary compressors including the two-cylinder type rotary compressor having dimensions described in this embodiment.

Specifically, the rotary compression mechanisms 5 and 6 respectively have blades 16 and 36 which are disposed in an inphase relation. Further, the eccentric direction of the piston 13 near the motor 2 is defined as a reference. Then, the piston 13 has a phase difference of $\theta$ in a direction opposite to the rotational direction of the rotating shaft 4. In this case, the range of $\theta$ is defined as $$\pi-\alpha<\theta<\pi.$$

The range of $\theta$ is determined depending on a satisfactory balance of the vibration in the rotational direction and the vibration in the radial direction.

In this embodiment, the phases of the blades 16 and 36 are determined to coincide with each other. The phase difference between the compression processes of the rotary compression mechanisms 5 and 6 is determined such that the phase difference between the pistons 13 and 33 is determined to be greater than 180 degrees. However, the present invention is not limited to this, the phase difference between the compression mechanisms 5 and 6 may be determined by any other techniques.

Figure 19:
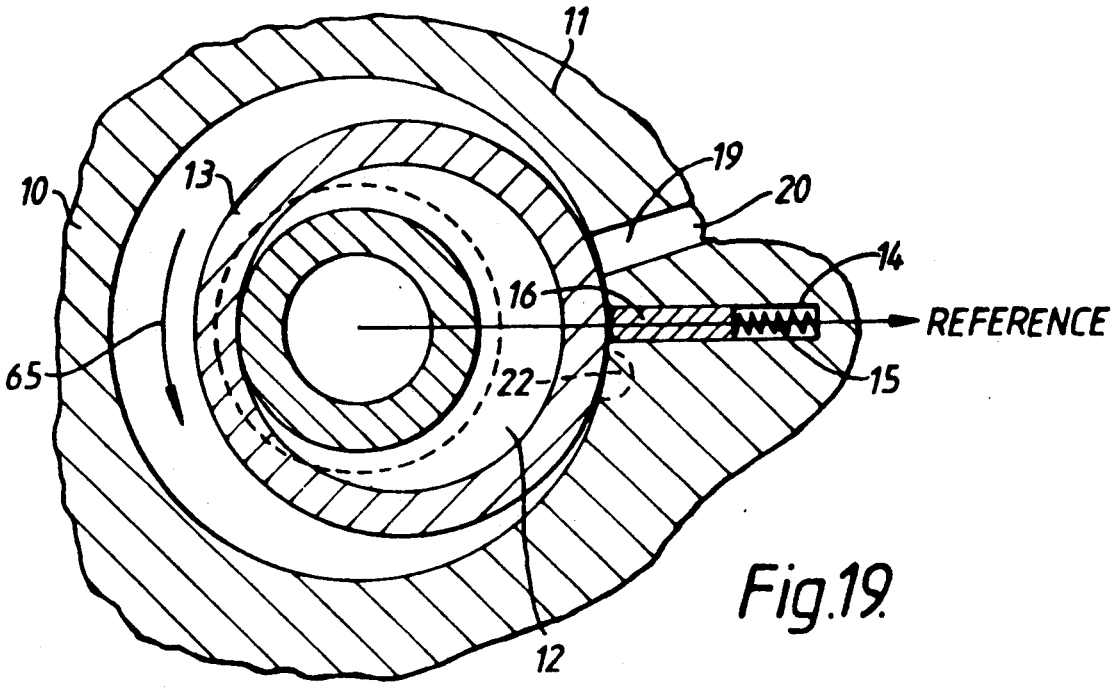
FIG. 19 is a partial sectional view taken in the direction of the arrows substantially along the line II—II of FIG. 1, according to a third embodiment of the present invention.
Figure 20:
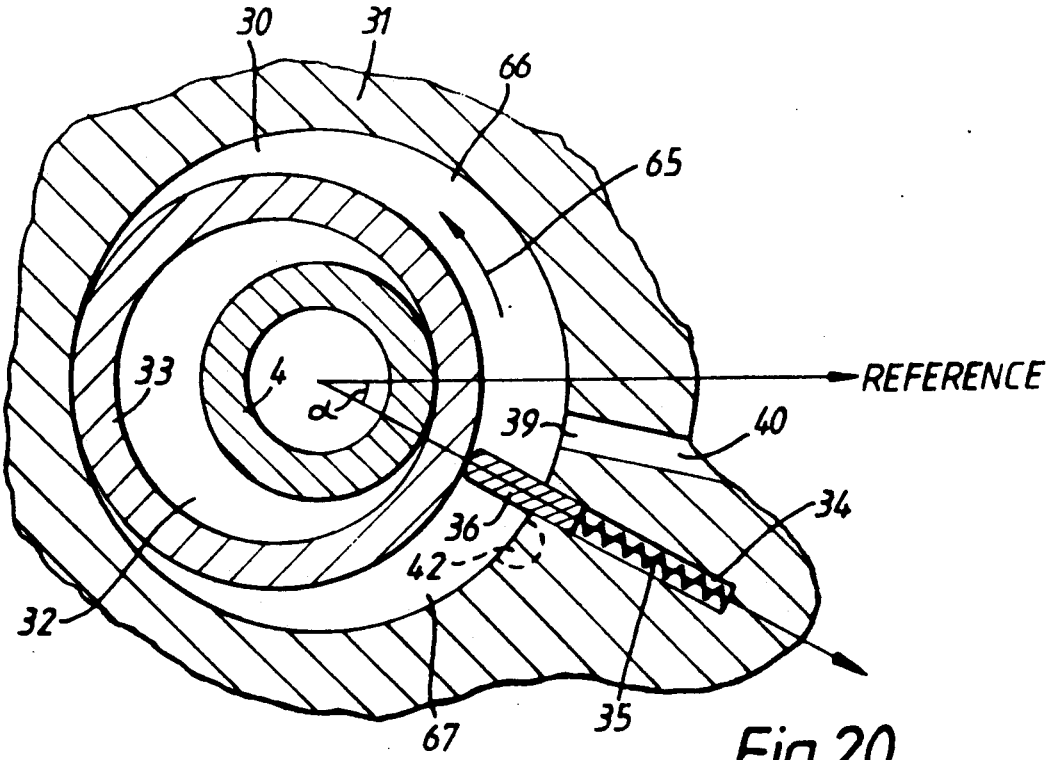
FIG. 20 is a partial sectional view taken in the direction of the arrows substantially along the line III—III of FIG. 1, according to the third embodiment of the present invention.

Next, a third embodiment according to the present invention will be described with reference to FIGS. 19 and 20. As shown in FIGS. 19 and 20, the phase difference between pistons 13 and 33 is determined to be about 180 degrees. However, the phase difference between blades 16 and 36 is changed in an appropriate range as follows.

Specifically, in the third embodiment, the phase of the blade 16 near a motor 2 is defined as a reference. The phase difference of the blade 33 with respect to the blade 13 is determined within a range of 0 to $\theta-(\pi-\alpha)$ in a direction opposite to the rotational direction of rotational shaft 4.

As a result, the phase difference between the compression processes of the two compression mechanisms 5 and 6 is determined as follows. Specifically, the starting point of the compression process of the compression mechanism 6 separated from the motor 2 lags by the angle of $\theta$ behind the starting point of compression process of the compression mechanism 5 nearer the motor. This can achieve the same function as that in the second embodiment.

Therefore, the objectionable beat from the two-cylinder type rotary compressor becomes insignificant. Further, the whirling of rotor 3, which is a cause of the vibrations, decreases significantly. Moreover, the bearing loads of journal bearings 18 and 38 can be reduced. Consequently, a two-cylinder type rotary compressor with low-vibration and low-noise can be provided.

In the above-described embodiments according to the present invention, when the first and second embodiments are practiced in combination, the inventors of this invention have confirmed by analysis of the pistons or the blade phases are shifted, the optimum positions of the oil-guiding grooves are substantially not influenced.

Moreover, when the blade phase is shifted, the position of the oil-guiding groove 56 (the first oil-guiding groove) may be determined using the blade 16 (near the motor) as a reference. Further, the position of the oil-guiding groove 60 (the second oil-guiding groove) may be determined by using the blade 36 (separated from the motor) as a reference.

Obviously, numerous additional modifications and variation of the present invention are possible in light of the above teachings. It is therefore to be understood that within the scope of the appended claims, the invention may be practiced otherwise than as specifically described herein.

What is claimed is:

1. A rotary compressor comprising:

a pair of cylinders, each defining a hollow space therein;

a shaft mounted for rotary movement in the cylinders;

a motor for rotating the shaft;

a piston corresponding to each cylinder, each piston surrounding the shaft for eccentrically rotating with the shaft in one of the spaces and compressing gas in the one space;

blade means for continuous slidable contact with each piston, including an individual planar blade for dividing each space into a suction chamber and a compression chamber;

first and second journal bearings for rotatably supporting the shaft, including an inner bearing surface on each bearing;

oil-guiding groove means for distributing oil from a source thereof over the entire bearing surfaces between the bearing surfaces and the shaft upon rotation of the shaft; including oil-guiding grooves respectively provided within said first and second bearings, said respective oil-guiding grooves being provided in the regions having constant negative pressure with respect to the outsides of the first and second bearings during operational rotation of said shaft.

2. A rotary compressor comprising:

a pair of cylinders, each defining a hollow space therein;

a shaft mounted for rotary movement in the cylinders;

a motor for rotating the shaft;

a piston corresponding to each cylinder, each piston surrounding the shaft for eccentrically rotating with the shaft in one of the spaces and compressing gas in the one space;

blade means for continuous slidable contact with each piston, including an individual planar blade for dividing each space into a suction chamber and a compression chamber;

first and second journal bearings for rotatably supporting the shaft, including an inner bearing surface on each bearing;

oil-guiding groove means for distributing oil from a source thereof over the entire bearing surfaces between the bearing surfaces and the shaft upon rotation of the shaft, including a first oil-guiding groove in the bearing surface of the first journal bearing, the first groove being provided in an area of angles between 220 and 325 degrees in the direction of rotation from a position of the blade, and a second oil-guiding groove in the bearing surface of the second journal bearing, the second groove being provided in the area of angles between 190 and 310 degrees in the direction of rotation from the position of the blade.

3. The rotary compressor of claim 2, wherein said first journal bearing is disposed on a position near the motor and said second journal bearing is disposed on a position separated from the motor.

4. The rotary compressor of claim 3, wherein said rotating shaft has a hollow portion therein, said hollow portion including means for drawing the lubricating oil and also having two lubricating bores, said oil-guiding grooves each including an inlet, and said lubricating bores supplying some of the drawn lubricating oil to said inlets of the first and second oil-guiding grooves.

5. The rotary compressor of claim 2, wherein said pair of journal bearings each includes an annular step portion, each said annular step portion communicating with the inlet of said first and second oil-guiding grooves.

6. The rotary compressor of claim 2, wherein each said piston has a compression phase being determined such that the starting point of said compression phase of one of said pistons separated from said motor being delayed by an angle $\theta$ from the starting point of compression phase of the other piston disposed near said motor, said angle $\theta$ being defined as $\pi-\alpha<\theta<\pi$, where $$\alpha = \cos^{-1}\left(\frac{c}{a+c}\right)$$

a: the axial distance along said rotating shaft between the centers of said two pistons, and c: the axial distance along said rotating shaft between the other end of said motor and the center of one of the pistons closest to said motor.

7. The rotary compressor of claim 6 wherein said determination of compression process phases is made in such a manner that said blades are disposed in phased relation, the eccentric direction of said piston near said motor is defined as a reference, and the eccentric direction of said piston separated from said motor is disposed with the phase difference of said angle $\theta$ in a direction opposite to the rotational direction of said rotating shaft.

8. The rotary compressor of claim 6, wherein said determination of compression process phases is made in such a manner that said pistons are disposed having a phase difference of $\pi$, said blade near said motor is defined as a reference, said motor is defined as a reference, and said other blade separated from said motor is disposed having a phase difference of $\theta-(\pi-\alpha)$ with respect to the reference blade, in a direction opposite to the rotational direction of said rotating shaft.

9. A rotary compressor having a rotating shaft driven by an electric motor and two compression mechanisms driven by said rotating shaft in common, each comprising:

a cylinder;

a piston supported and rotated by said rotating shaft eccentrically within said cylinder;

a blade attached to said cylinder so as to always make a slidable contact with the outer circumferential surface of said piston for dividing said cylinder into a suction chamber and a compression chamber;

a gas suction inlet communicating with said suction chamber;

a gas discharge outlet communicating with said compression chamber;

said two compression mechanisms being disposed coaxially so as to cause the phases of said blades to coincide with each other;

a pair of journal bearings for supporting said rotating shaft at portions projecting from both the upper and lower sides of two compression mechanisms;

said two rotary compression mechanisms having the compression phases being determined such that the starting point of compression phase of one of said rotary compression mechanism separated from said motor being delayed by an angle $\theta$ from the starting point of compression phase of the other one of said rotary compression mechanism disposed near said motor, said angle of $\theta$ being defined as $\pi-\alpha<\theta<\pi$, where $$\alpha = \cos^{-1}\left(\frac{c}{a+c}\right)$$

a: the axial distance along said rotating shaft between the centers of said two pistons, c: the axial distance along said rotating shaft between the other end of said motor and the center of one of the pistons closest to said motor.

10. The rotary compressor of claim 9, wherein said determination of compression phases is made in such a manner that the said blades are disposed in the inphase relation, that the eccentric direction of said piston near said motor is defined as a reference, and that the eccentric direction of said piston separated from said motor is disposed with the phase difference of said angle of $\theta$ in a direction opposite to the rotational direction of said rotating shaft.

11. The rotary compressor of claim 9, wherein said determination of compression process phases is made in such a manner that the said pistons are disposed having a phase difference of $\pi$, that said blade near said motor is defined as a reference, and that said other blade separated from said motor is disposed having a phase difference of $\theta-(\pi-\alpha)$ with respect to the reference blade in a direction opposite to the rotational direction of said rotating shaft.

* * * * *